US007904970B2

(12) United States Patent
Thomas

(10) Patent No.: US 7,904,970 B2
(45) Date of Patent: Mar. 15, 2011

(54) HEADWEAR WITH FEATURES FOR HOLDING EYEGLASSES

(75) Inventor: Justin B. Thomas, Dublin, GA (US)

(73) Assignee: J-Brem, LLC, Atlanta, GA (US)

( * ) Notice: Subject to any disclaimer, the term of this patent is extended or adjusted under 35 U.S.C. 154(b) by 24 days.

(21) Appl. No.: 12/390,109

(22) Filed: Feb. 20, 2009

(65) Prior Publication Data

US 2010/0212067 A1 Aug. 26, 2010

(51) Int. Cl.
*A42B 1/24* (2006.01)

(52) U.S. Cl. ..... 2/209.13; 2/209.12; 2/195.6

(58) Field of Classification Search ..... 2/209.11, 2/209.12, 209.13, 175.1, 175.4, 175.5, 195.1, 2/195.5, 195.6, 249, 250
See application file for complete search history.

(56) References Cited

U.S. PATENT DOCUMENTS

| | | | | |
|---|---|---|---|---|
| 3,344,437 | A * | 10/1967 | Greene | 2/195.6 |
| 3,855,634 | A * | 12/1974 | Gregg | 2/172 |
| 4,030,140 | A | 6/1977 | Burt | |
| 4,179,753 | A | 12/1979 | Aronberg | |
| 4,304,005 | A | 12/1981 | Danley, Sr. | |
| 5,052,054 | A | 10/1991 | Birum | |
| 5,105,475 | A | 4/1992 | Lynd et al. | |
| 5,533,207 | A | 7/1996 | Diaz | |
| 5,533,208 | A | 7/1996 | Tonoyan et al. | |
| 5,815,832 | A | 10/1998 | Skolik | |
| 5,860,167 | A | 1/1999 | Lizio | |
| 5,867,874 | A | 2/1999 | Simpson | |
| 5,887,287 | A | 3/1999 | Potochnik | |
| 5,943,704 | A * | 8/1999 | Oxman | 2/209.13 |
| 6,185,748 | B1 | 2/2001 | Dechambeau | |
| 6,237,159 | B1 | 5/2001 | Martin | |
| 6,298,495 | B1 | 10/2001 | Totani | |

(Continued)

FOREIGN PATENT DOCUMENTS

WO WO-2009049743 2/2010

OTHER PUBLICATIONS

"PCT Invitation to Pay Additional Fees and, where applicable, Protest Fee", PCT Application No. PCT/US2009/049743 Nov. 11, 2009.

*Primary Examiner* — Gary L Welch
*Assistant Examiner* — Sally C Cline
(74) *Attorney, Agent, or Firm* — Kilpatrick Townsend & Stockton LLP

(57) ABSTRACT

Stem holders are attached to opposing sides of the headwear crown, each forming an opening extending from its front edge to its back edge. The front and back edges of each stem holder may be partially attached to the crown such that the opening is larger along the front than along the back. At least a portion of the opening may be angled downward from front to back. For brimmed headwear, a raised flair may be positioned on the brim to create a pocket between it and the crown. For brimless headwear, the raised flair may be attached to the front of the crown to form a pocket between it and at least a portion of the crown. In either the brimmed or brimless configuration, the lens portion of the glasses will rest in the pocket when the stems of the glasses are inserted into the stem holders.

8 Claims, 6 Drawing Sheets

U.S. PATENT DOCUMENTS

| | | | | |
|---|---|---|---|---|
| 6,314,583 | B1 | 11/2001 | Cho | |
| 6,481,059 | B2 | 11/2002 | Morris | |
| 6,637,074 | B1 | 10/2003 | Morris | |
| 6,644,807 | B1 | 11/2003 | Hood | |
| 6,647,554 | B1 | 11/2003 | Yan | |
| 6,668,426 | B1 | 12/2003 | Morris | |
| 6,671,885 | B2 | 1/2004 | Viggiano | |
| 6,792,619 | B1 | 9/2004 | Morris et al. | |
| 6,804,831 | B2 * | 10/2004 | Guerra | 2/209.11 |
| D503,261 | S * | 3/2005 | Pedersen | D2/882 |
| 6,935,741 | B2 | 8/2005 | Denney | |
| 6,935,742 | B1 | 8/2005 | Wilson, Sr. | |
| 6,944,882 | B2 | 9/2005 | Lawrence et al. | |
| 7,003,809 | B1 | 2/2006 | Gordon | |
| 7,013,491 | B2 | 3/2006 | Ferrar | |
| 7,051,406 | B1 | 5/2006 | Morris | |
| 7,069,599 | B2 * | 7/2006 | Guerra | 2/209.11 |
| 7,165,273 | B1 | 1/2007 | Redmond | |
| 7,255,436 | B2 | 8/2007 | Tracy | |
| 7,275,270 | B2 | 10/2007 | Cotutsca | |
| 7,398,560 | B1 * | 7/2008 | Swensen | 2/182.3 |
| 7,461,764 | B2 | 12/2008 | Thompson | |
| 7,484,845 | B2 | 2/2009 | Douglas | |
| 2002/0186557 | A1 * | 12/2002 | Lary et al. | 362/106 |
| 2005/0039240 | A1 | 2/2005 | Kidouchim | |
| 2005/0132460 | A1 | 6/2005 | Ko | |
| 2006/0152671 | A1 | 7/2006 | Risso et al. | |
| 2006/0268221 | A1 | 11/2006 | Tracy | |
| 2007/0028360 | A1 * | 2/2007 | Cotutsca | 2/209.13 |
| 2007/0101480 | A1 | 5/2007 | Douglas | |
| 2007/0220656 | A1 | 9/2007 | Cotutsca | |
| 2007/0229759 | A1 | 10/2007 | Jones | |
| 2007/0256214 | A1 | 11/2007 | Mcgowan et al. | |
| 2007/0271677 | A1 | 11/2007 | Romanski et al. | |
| 2007/0283482 | A1 * | 12/2007 | Lawrence | 2/209.12 |
| 2008/0028498 | A1 | 2/2008 | Beheton | |
| 2008/0066215 | A1 | 3/2008 | Thompson | |
| 2009/0056000 | A1 * | 3/2009 | de Taboada | 2/422 |
| 2009/0158501 | A1 * | 6/2009 | Lowe et al. | 2/209.13 |
| 2009/0199321 | A1 * | 8/2009 | Stingone | 2/209.12 |

* cited by examiner

HEADWEAR WITH FEATURES FOR HOLDING EYEGLASSES

FIELD OF THE INVENTION

The present invention relates generally to headwear having features for holding a pair of eyeglasses thereon.

BACKGROUND

It has become common practice, for convenience and/or style, for hat wearers to rest their eyeglasses (i.e., sunglasses, reading glasses, etc.) on their hats and other headwear when the glasses are not otherwise in use. As is well know, one method of doing this involves making stems of the glasses to abut opposite sides of the crown of the headwear. For brimmed headwear, the lenses (or frames holding the lenses) of the glasses can be made to rest on the brim. The size and configuration of the glasses in relation to the headwear determine how snugly the glasses will mate with the crown and thus how well the glasses will stay mounted to the headwear as the wearer moves about. In general, however, absent some mechanism to hold the glasses in place, glasses will typically not stay mounted to headwear if the wearer engages in any activity that involves significant head movement.

There have been many attempts to provide headwear with features for holding a pair of eyeglasses in place on the crown and/or brim of the headwear. For example, it is known to provide a pair of "stem holders" or "keepers" on opposing sides of a hat for receiving the stems of the glasses. Several such stem holder designs have been proposed, each claiming to retain a pair of glasses more securely on a hat than prior solutions. See, for example, U.S. Pat. Nos. 6,237,159; 6,647,554; 6,671,885; 6,792,619; 7,275,270; and 7,484,845.

However, none of these prior stem holder designs are capable of impeding movement of the lens portion of the glasses relative to the brim of the headwear (or the front of brimless headwear). As a result, such stem holders alone tend to be ineffective at preventing the glasses from too often falling from the hat. Other proposed solutions involve application of hardware (such as a clip or other retainer) to a hat brim or the front of the crown for receiving and holding the lenses or lens frames of the glasses. See, for example, U.S. Pat. No. 4,179,753 and United States Patent Publication No. 2007/0229759. Such solutions tend to be cumbersome in use and appearance and not aesthetically pleasing. Therefore, a need exists for headwear having improved features for more securely holding a pair of eyeglasses thereon.

SUMMARY OF THE INVENTION

The present invention provides headwear with features for holding a pair of glasses thereon. The headwear includes at least a crown and may or may not include a brim. The crown may have stem holders on opposing sides thereof. Each stem holder is designed to receive one of the stems of the pair of glasses. Each stem holder may comprise a patch of material attached to the crown along the top edge and bottom edge of the patch, so as to form an opening extending from the front edge to the back edge of the patch. The front edge and the back edge of the patch may also each be partially attached to the crown in such a manner that the opening is larger along the front edge than along the back edge. In addition, portions of the interior of the patch may be attached to the crown in such a manner that at least a portion of the opening is angled downward in a direction from the front edge to the back edge of the patch.

In cases where the headwear includes a brim, the brim may have a raised flair positioned thereon so as to create a pocket between the raised flair and the crown. The pocket is designed to receive a lens portion of the pair of glasses. The raised flair may be shaped in the form of an arc, the length of which runs along the width of the brim. The height of the raised flair may be tallest at its center point and may taper towards each end of the raised flair. In some cases, the brim of the headwear will comprises an inner support structure covered by a cover material. The raised flair may be formed as part of the inner support structure. Alternatively, the raised flair may be formed separately from and attached to the inner support structure or brim. The raised flair may be fully or partially covered by the cover material when the brim is fully constructed, or may remain exposed from the cover material.

In cases where the headwear does not include a brim, a raised flair may be attached to the front of the crown. The raised flair may be shaped and attached to the front of crown so as to form a pocket between the raised flair and at least a portion of the crown. With this configuration, the lens portion of the glasses will rest in the pocket when the stems of the glasses are inserted into the stem holders on the sides of the crown. These and other features, aspects and embodiments of the present invention will be described further in the detailed description below in connection with the appended drawings and claims.

DETAILED DESCRIPTION OF EXEMPLARY EMBODIMENTS

Figure 1A:
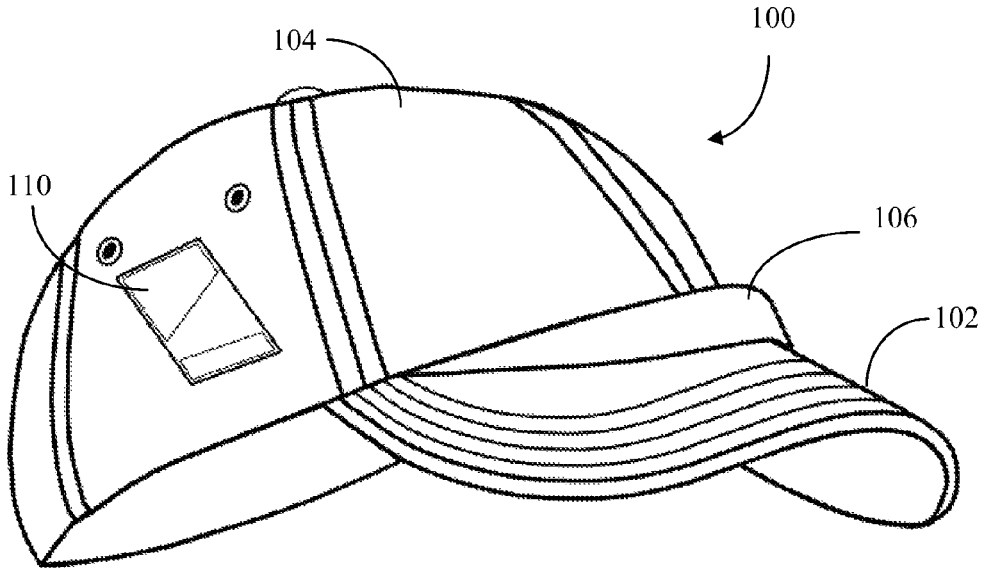
FIGS. 1A and 1B are perspective and side views, respectively, of a hat having features for holding a pair of eyeglasses on its crown and brim, in accordance with certain exemplary embodiments of the present invention.

The present invention provides headwear with features for holding a pair of eyeglasses thereon. The headwear contemplated by the present invention may be any style of hat, cap, visor, helmet, do-rag (also spelled "doo-rag" or "durag") or other headwear item having at least a crown. The term "crown" is used herein to mean a portion of the headwear that encircles or at least partially encircles the wearer's head. The crown may fully or partially cover the wearer's head (e.g., baseball hats, cowboy hats, hardhats, helmets, etc.) or may leave the head uncovered (e.g., golf visors and the like). The headwear contemplated by the present invention may or may not have a brim. As used herein, the term "brim" is intended to refer to any brim, visor, bill, shade or other protrusion from the crown of the headwear.

The headwear features contemplated by the present invention are designed to hold and keep any type of glasses (e.g., reading glasses, sunglasses, etc.) in place on the crown and/or brim of the headwear while the wearer is performing any activity. In particular, a raised feature (also referred to herein as a "flair") is formed on or added to the brim or crown of the headwear and stem holders are formed on or added to opposite sides of the crown. Space between the raised flair and the crown forms a pocket or groove, in which the lenses (or lens frame) of a pair of glasses may rest. The stem holders are designed to hold the stems of a pair of eyeglasses, such that one stem is positioned on each opposing side of the crown. The pocket or groove formed by the raised flair prevents or at least impedes movement of the lenses or lens frame relative to the brim (or front of the crown in brimless applications) and thus holds the glasses in place on the headwear even during rigorous activity.

Exemplary embodiments of the present invention will hereinafter be described with reference to the drawings, in which like numerals are used to indicate like elements. For the sake of convenience, the drawings are not drawn to scale and any reference herein to exemplary dimensions of the invention or elements thereof are not intended to be reflected as such in the drawings. In addition, directional references used herein, such as front, back, top, bottom, etc. are intended to be relative to ordinary or normal usage of the described headwear and are therefore not to be taken as limiting of the present invention in cases where headwear is worn in other manners (e.g., backwards and/or upside-down and/or sideways). Although many of the exemplary embodiments are described with reference to a brimmed hat, which is depicted in the drawing as a baseball-type hat, those skilled in the art will appreciate that the inventive headwear features can be applied to any type of brimmed or brimless headwear.

Figure 1B:
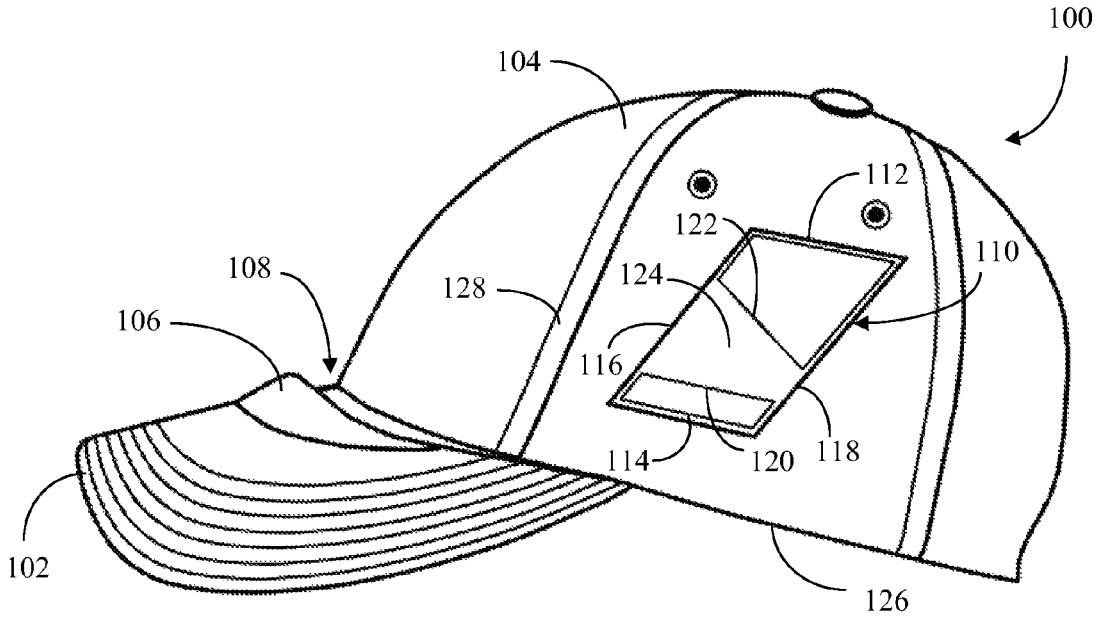

FIGS. 1A and 1B are perspective and side views, respectively, of a hat 100 in accordance with certain exemplary embodiments of the present invention. The exemplary hat 100 includes a brim 102 and a crown 104. The brim 102 includes a raised feature, which is referred to herein as a raised flair 106. The raised flair 106 is formed on or added to the brim 102, as will be described in more detail below. The raised flair 106 is positioned on the brim 102 so as to create a pocket 108 or groove between the raised flair 106 and the crown 104. The size and geometry of the pocket 108 will depend on the size and geometry of the raised flair 106 and the crown 104, as well as the placement of the raised flair on the brim 102 relative to the crown 104.

Figure 2A:
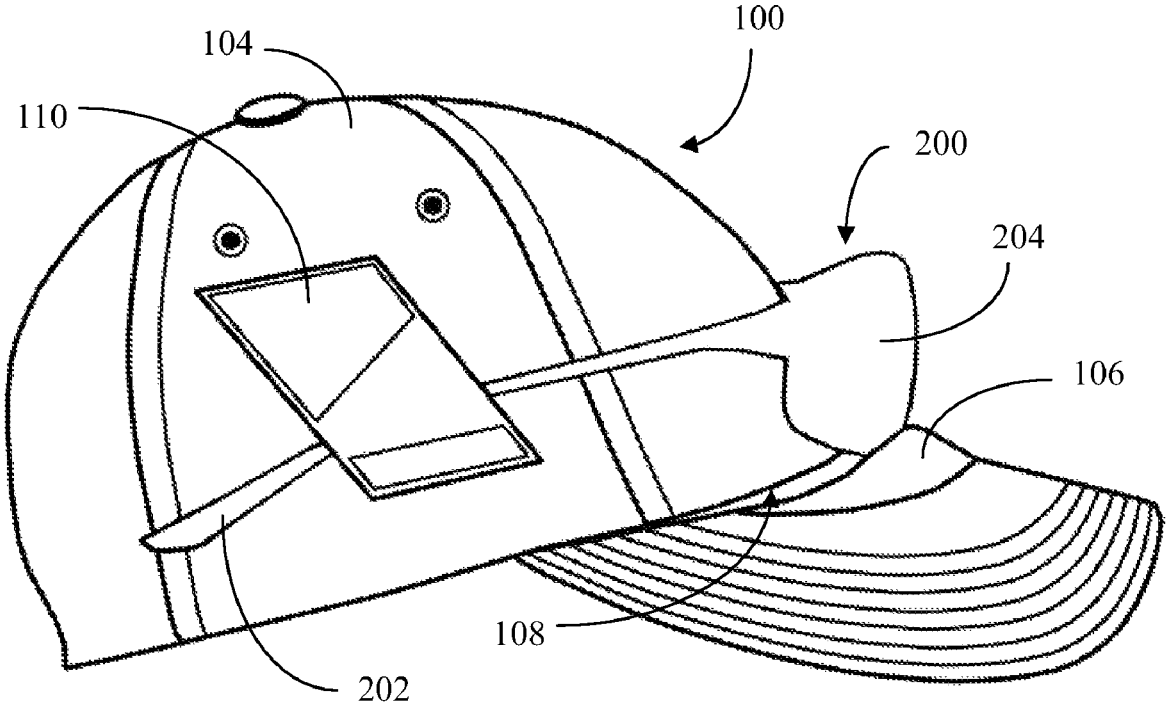
FIGS. 2A and 2B are side and front views, respectively, of a hat having features for holding a pair of eyeglasses on its crown and brim and showing a pair of eyeglasses mounted thereon, in accordance with certain exemplary embodiments of the present invention.
Figure 2B:
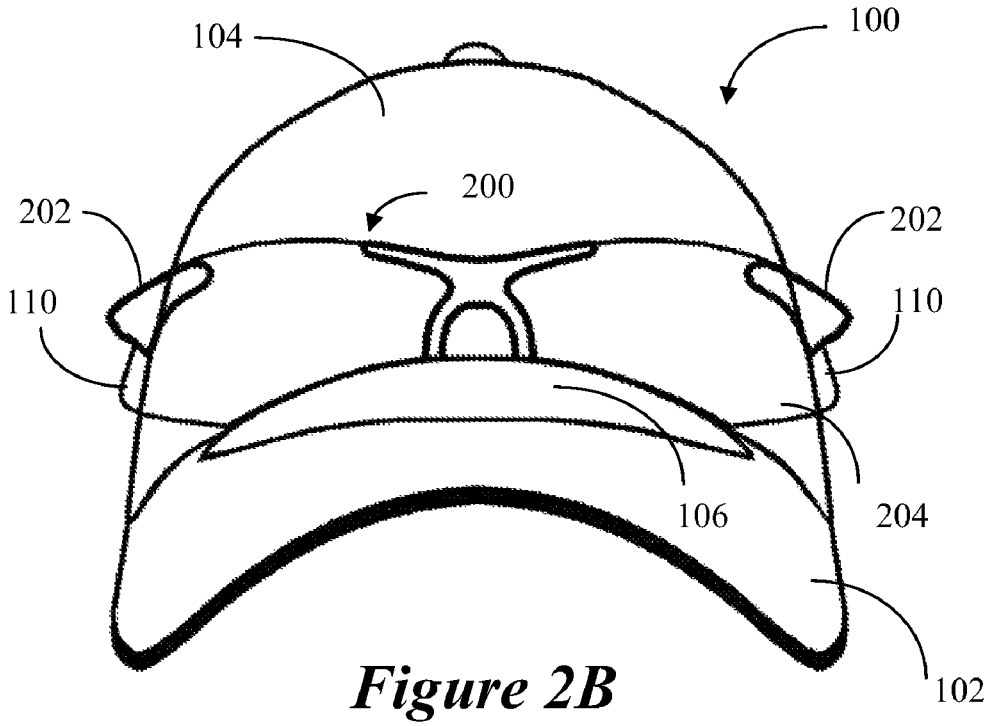

Stem holders 110 may be attached to or formed on opposite sides of the crown 104. As shown in FIGS. 2A and 2B, the stem holders 110 receive the stems 202 of the glasses 200 and thereby help to hold and support the glasses 200 on the headwear 100. As is also shown in FIGS. 2A and 2B, the pocket 108 receives the lenses or lens frame (referred to herein for simplicity as the "lens portion" 204) of a pair of glasses 200, when the glasses 200 are mounted on the hat 100. Accordingly, the raised flair 106 impedes movement of the lens portion 204 of the glasses 200 relative to the brim 102 so that the glasses will not slide off the brim 102, while the stem holders 110 retain the stems 202 of the glasses 200 in place next to the crown 104.

Each stem holder 110 may be formed by attaching a patch of fabric or other material to the crown 104, such as by stitching, staples, tacks, pins, adhesive or any other suitable type of fastener. Each patch of fabric may be of any desired shape, including without limitation rectangular, square, polygonal, circular, oval and any variation thereof. In some embodiments, a patch used to form a stem holder 110 may be in the shape of an icon, image or logo. A stem holder 110 may be made of self-fabric (i.e., the same fabric as the crown 104) or may be made fabric that is a different type or color than that of the crown 104. In some embodiments, a stem holder 110 may be made of a material having elastic properties, so as to hold the stems 202 of the glasses 200 more snugly against the crown 104. In other embodiments, a stem holder 110 may be made of a textured material (e.g., leather), so as to hold the stems 202 of the glasses 200 with more friction force.

With reference to FIG. 1B, the illustrated embodiment includes stem holders 110 that are approximately rectangular in shape, each of which is stitched or otherwise fastened to the crown 104 along its top edge 112 and bottom edge 114, thereby forming an opening 124 through the stem holder that extends from its front edge 116 to its back edge 118. As shown, each exemplary stem holder 110 is also partially stitched or otherwise fastened to the crown 104 along the front edge 116 and back edge 118 in such a way that the opening 124 is larger along the front edge 116 than along the back edge 118. Reinforcing stitches or fasteners (120, 122) may also be added within the interior of the stem holder 110, as shown. In a preferred embodiment, the stem holders 110 are approximately 2 inches long by 1¼ inches wide. The bottom edge 114 of each stem holder 110 is preferably positioned approximately 1 inch from the base 126 of the crown 104. The front edge 116 of each stem holder 110 is preferably positioned approximately 1 inch rearward of the region of the crown 104 that sits above the wearer's temple (e.g., the front side seam 128 of the crown 104). Such dimensions are not, however, limitations of the scope of the present invention and will necessarily vary depending on the shape and size of the crown 104 and/or brim 102.

Figure 3:
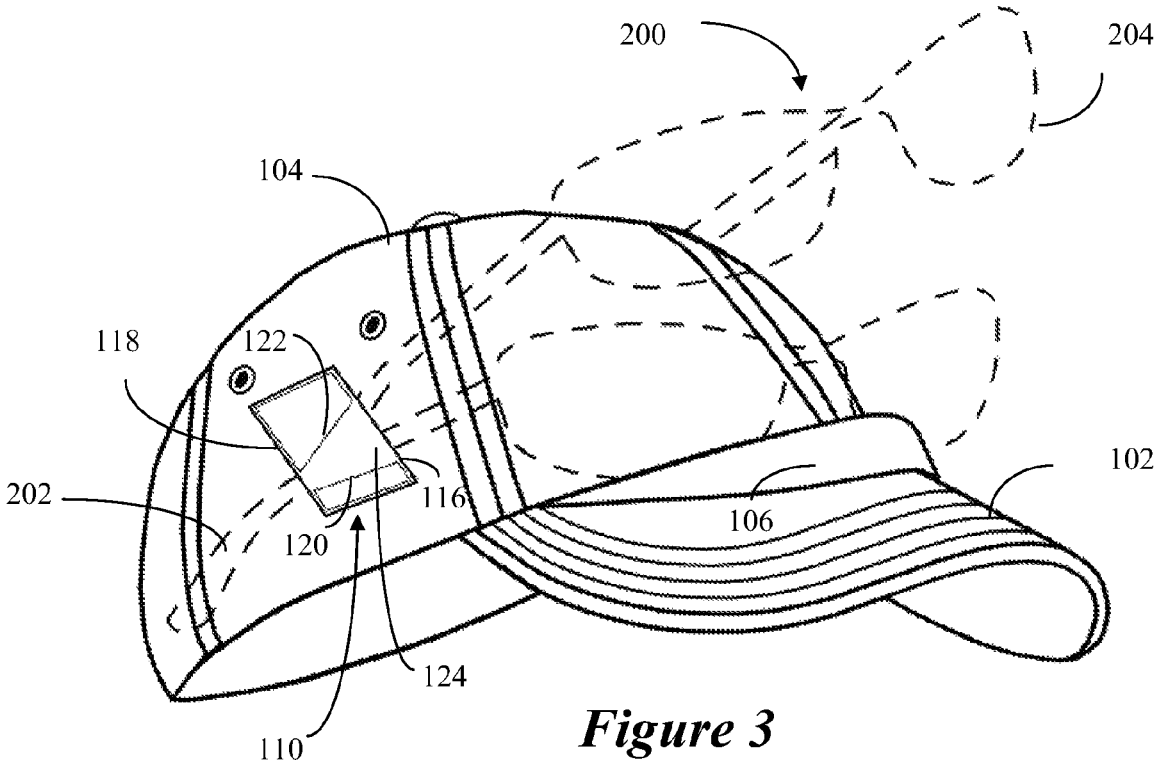
FIG. 3 is a perspective view of a hat having features for holding a pair of eyeglasses on its crown and brim and showing a pair of eyeglasses being mounted thereon, in accordance with certain exemplary embodiments of the present invention.

In embodiments where reinforcing stitches or fasteners 120, 122 are used to reinforce the opening 124 through the stem holder 110, the upper reinforcing stitch or fastener 122 may be angled away from the lower reinforcing stitch or fastener 120 in a direction towards the top front of the crown 104. As a result of this configuration the top of the opening 124 is sloped downward in the direction extending from the front edge 116 to the back edge 118. As shown in FIG. 3, such a sloped opening 124 allows the stem 202 of a pair of glasses 200 (which often has a curved or angled end) to be easily inserted into the stem holder 110 from an angle that is in an upward direction relative to the brim 102. After the stem 202 is inserted into the stem holder 110 and the lens portion 204 of the glasses 200 is lowered into the pocket 108, the angle of the stem 202 relative to the sloped opening 124 of the stem holder 110 is changed. With the glasses 200 in this seated position, the sloped opening 124 of the stem holder 110 makes it relatively difficult to remove the stem 202 from the stem holder 110. Those skilled in the art will recognize that other configurations of the reinforcing stitches or fasteners 120, 122 can be used to achieve substantially the same effect.

Although the exemplary stem holders 110 described herein are deemed to be novel and non-obvious over the known art, it should be appreciated that the present invention is not limited to such stem holders 110. In particular, the raised flair 106 feature of the present invention may be used on headwear in combination with any other type of stem holder, including those described in the prior art patent references noted herein. Furthermore, in some embodiments, headwear may be provided with only the raised flair 106 feature (i.e., without stem holder 110 features). Conversely, in still further embodiments, headwear may be provided with only the exemplary stem holders 110 described herein (i.e., without the raised flair 106 feature).

As is typical in baseball-style hats and the like, the brim 102 of the hat 100 may comprise an inner support structure and a cover material. The inner support structure may be a shaped piece of plastic, cardboard or other rigid or semi-rigid material. The cover material may be any suitable type of material, such as cloth or fabric, canvas, leather, rubber, etc. Other brim constructions, i.e., those not having an inner support structure and a cover material, are also contemplated by the present invention.

Figure 4A:
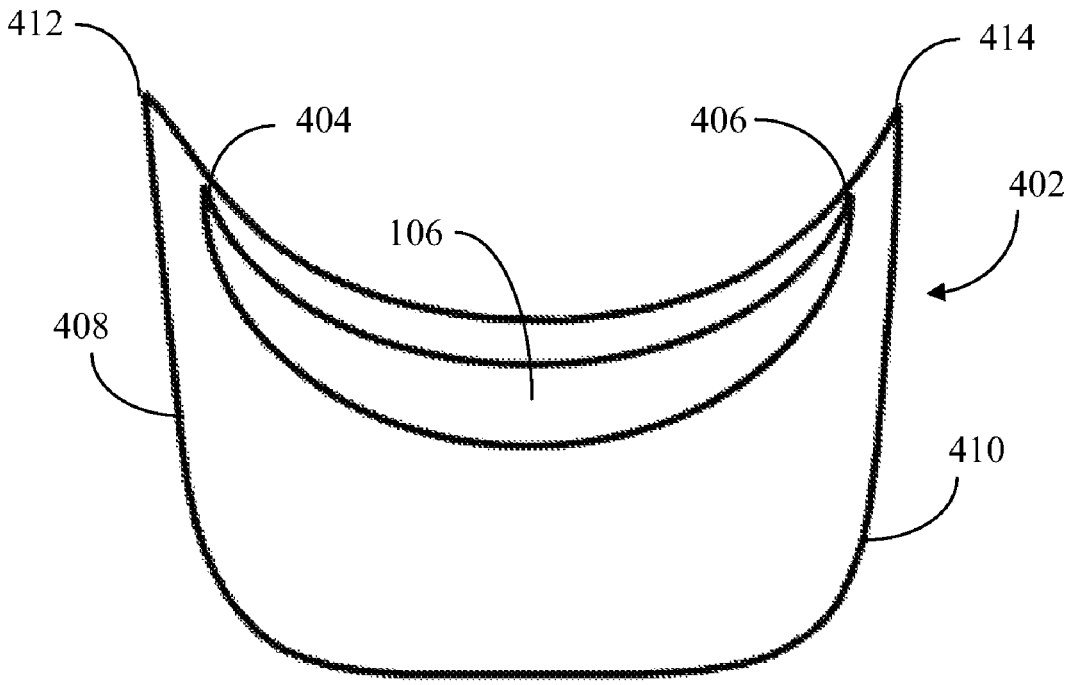
FIGS. 4A and 4B are top and side views, respectively, of an inner support structure of a hat brim having a raised flair feature formed thereon, in accordance with certain exemplary embodiments of the present invention.
Figure 4B:
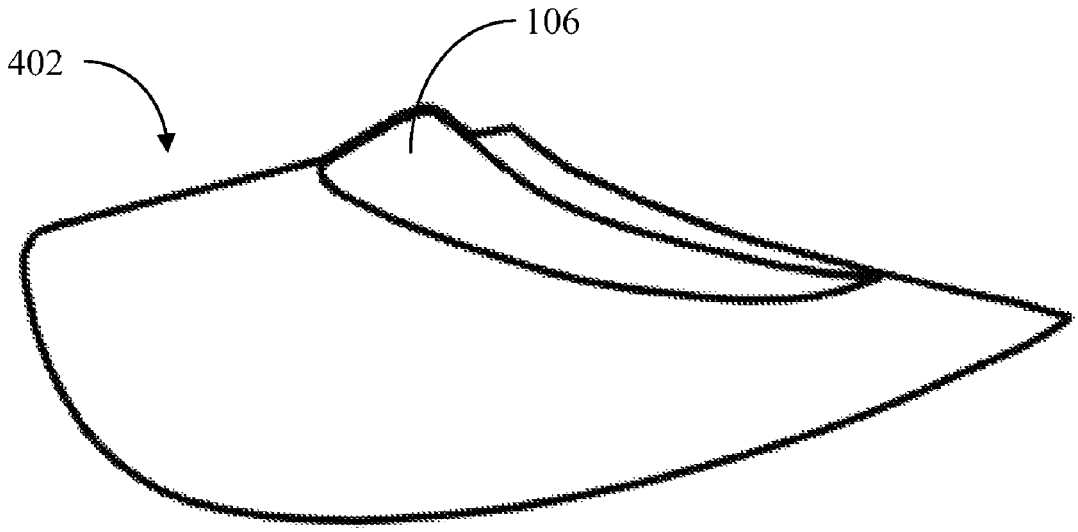

In embodiments where the brim 102 comprises an inner support structure and a cover material, the raised flair 106 and inner support structure may be molded or otherwise formed as a single component (e.g., a single piece of molded or cast plastic). FIGS. 4A and 4B illustrate top and side views, respectively, of a exemplary inner support structure 402 having a raised flair 106 formed thereon. In such embodiments, the raised flair 106 is preferably covered by the cover material when the brim 102 is fully constructed. However, in other embodiments, the raised flair 106 may remain exposed or partially exposed from the cover material.

Figure 5A:
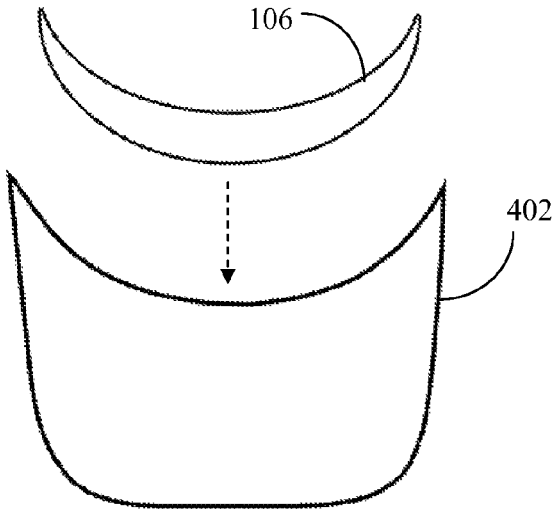
FIGS. 5A and 5B are top and side views, respectively, of an inner support structure of a hat brim having a raised flair feature applied thereto, in accordance with certain exemplary embodiments of the present invention.
Figure 5B:
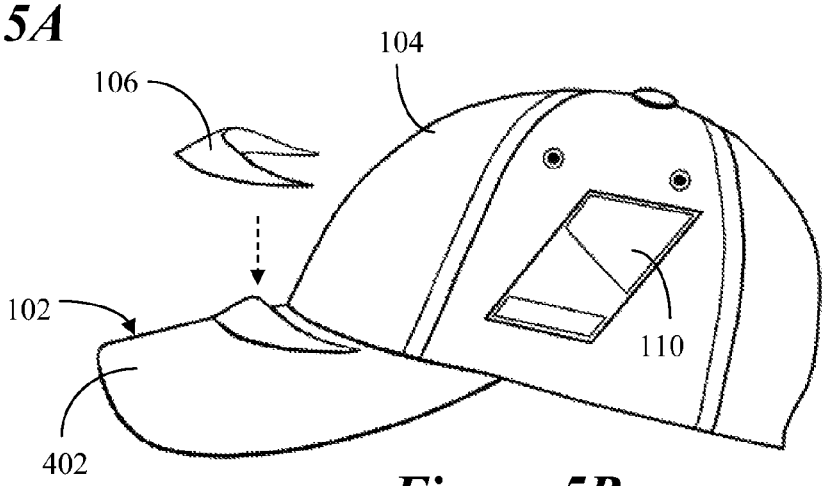

As another example, the raised flair 106 may be attached to the brim 102 using an appropriate adhesive (e.g., glue, epoxy, etc.) or fastener (e.g., stitching, staples, rivets, pins, tacks, tape, clips, etc.). Such a construction is illustrated in FIGS. 5A and 5B, where the raised flair 106 is made separately from the inner support structure 402 and subsequently attached thereto. The raised flair may be constructed of any suitable material, such as plastic, rubber, cardboard, foam, fabric, etc. Preferably, the material used to form the raised flair 106 is sturdy enough to maintain its shape over time and lightweight enough to not cause discomfort to the wearer of the headwear 100.

The raised flair 106 may be attached to the inner support structure 402 (or brim 102) before the brim 102 is attached to the crown 104 (as shown in FIG. 5A) or after the brim 102 is attached to the crown 104 (as shown in FIG. 5B). In some embodiments, the attached raised flair 106 may be covered by the cover material of the brim 102 when the brim 102 is fully constructed. In other embodiments the raised flair 106 may sit on top of the cover material or may remain exposed or partially exposed from the cover material of the brim 102. In yet other embodiments, the raised flair 106 may be sold as an aftermarket accessory to be attached to the brim 102 of a hat 100 (or to the crown of brimless headwear) by a merchant, purchaser or other party.

As shown throughout the figures, the raised flair 106 may be arced or curved along its length (which runs along the width of the brim 102) so as to approximate the shape and/or contour of the brim 102 and/or crown 104. In the illustrated embodiments, the height of the raised flair 106 varies along its length, with the tallest point being in the center and the height tapering towards each end. In certain preferred in embodiments, the raised flair 106 is approximately ¼ inch in height at its center point and tapers to approximately 0 inch in height on each side. In other embodiments, the raised flair 106 is between approximately ¼ and ½ inch in height at its center point and tapers to approximately 0 inch in height on each side. Raised flairs 106 having heights of less than ¼ inch and greater than ½ inch are also possible in other embodiments.

The length of the raised flair 106 may or may not occupy the full width of the brim 102. In a preferred configuration, represented in FIG. 4A, the length of the raised flair 106 is such that each of its ends 404, 406 is located approximately 1 inch from the applicable side 408, 410 of the brim 104 and approximately 2 inches from the applicable rear corner 412, 414 of the brim 102 (i.e., where the brim 102 meets the crown 104). However, in other embodiments the raised flair 106 may have other lengths and in some configurations the length of the raised flair 106 may be substantially the same as the width of the brim 102.

Figure 6:
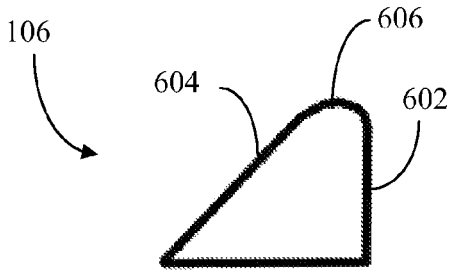
FIG. 6 is a cross-sectional view of an exemplary raised flair feature that is formed on or applied to the brim or crown of an article of headwear, in accordance with certain exemplary embodiments of the present invention.

FIG. 6 is a cross-sectional view of an exemplary raised flair design according to certain embodiments of the invention. The cross-section is taken at or near the center point of the exemplary raised flair 106 that is shown in the other figures. In this illustration, the back edge 602 of the raised flair 106, which faces the crown 104 of the headwear 100, is substantially straight. In other embodiments, the back edge 602 may be concave or convex. The front edge 604 is shown as being upwardly sloped and the top 606 of the raised flair 106 is shown as being rounded. Again, other shapes and configurations are possible and are contemplated by the present invention. For example, the front edge 604 of the raised flair 106 may be rounded or partially rounded and the top 606 of the raised flair 106 may be pointed or squared or may have any other polygonal or irregular shape.

In accordance with a preferred embodiment, the raised flair 106 is positioned on the brim 102 such that the center point of the raised flair 106 is approximately ½ inch from the junction of the brim and the crown. This positioning creates a pocket 108 of ample size to accommodate many different styles of glasses 200. A smaller or larger pocket 108 may be created by altering the position of the raised flair 106. In this way, pocket sizes can be tailored or customized to particular types or brands of glasses 200.

Those skilled in the art will appreciate that the geometry and dimensions of the raised flair 106 in the preferred and illustrated embodiments are based on functional as well as aesthetic considerations. Functionally, as described above, the raised flair 106 creates a pocket 108 for receiving the lens portion 204 of a pair of glasses 200 and impeding the lens portion 204 from moving relative to the brim 102 of the hat 100 (or relative to the front of the crown in brimless applications). Many other geometries will allow the raised flair 106 to function in the same or similar fashion and are thus contemplated by the present invention. For example, the geometry of the raised flair 106 may be substantially linear, rectangular or cylindrical along its length and/or may be curved or angled in any number of shapes. As another example, the height of the raised flair 106 may be constant along its length or may be varied along its length such that one or more points (not necessarily the center point) are taller than other points.

Figure 7A:
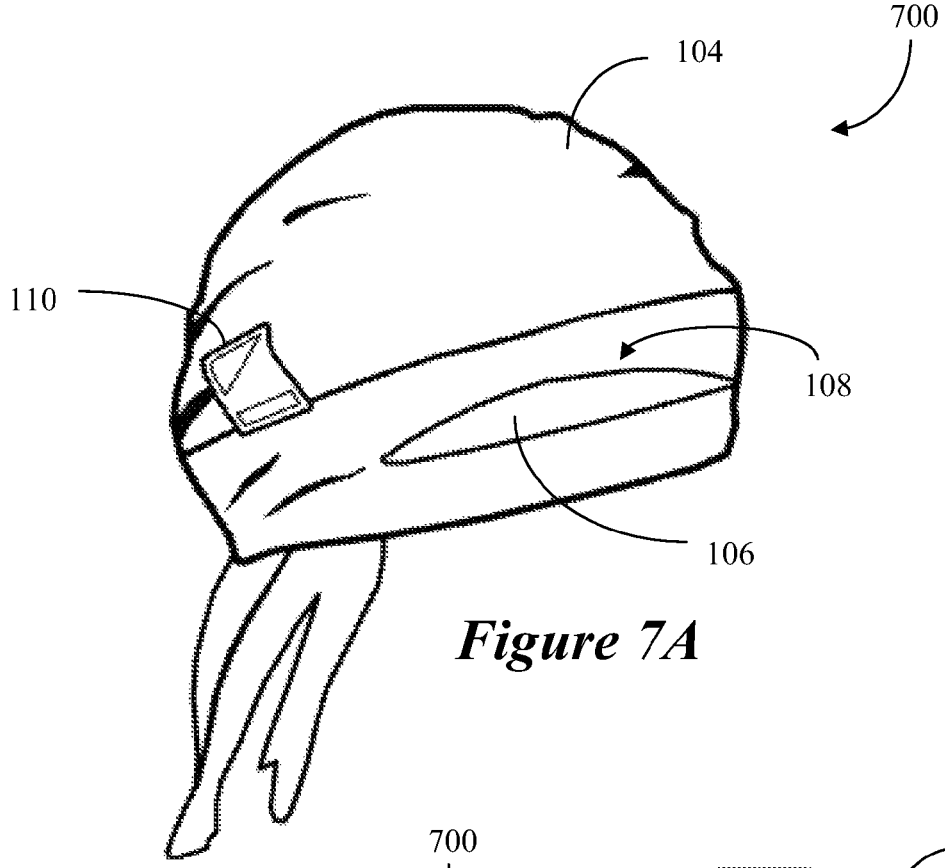
FIG. 7A is a perspective view of a brimless headwear article having features for holding a pair of eyeglasses on its crown, in accordance with certain exemplary embodiments of the present invention.
Figure 7B:
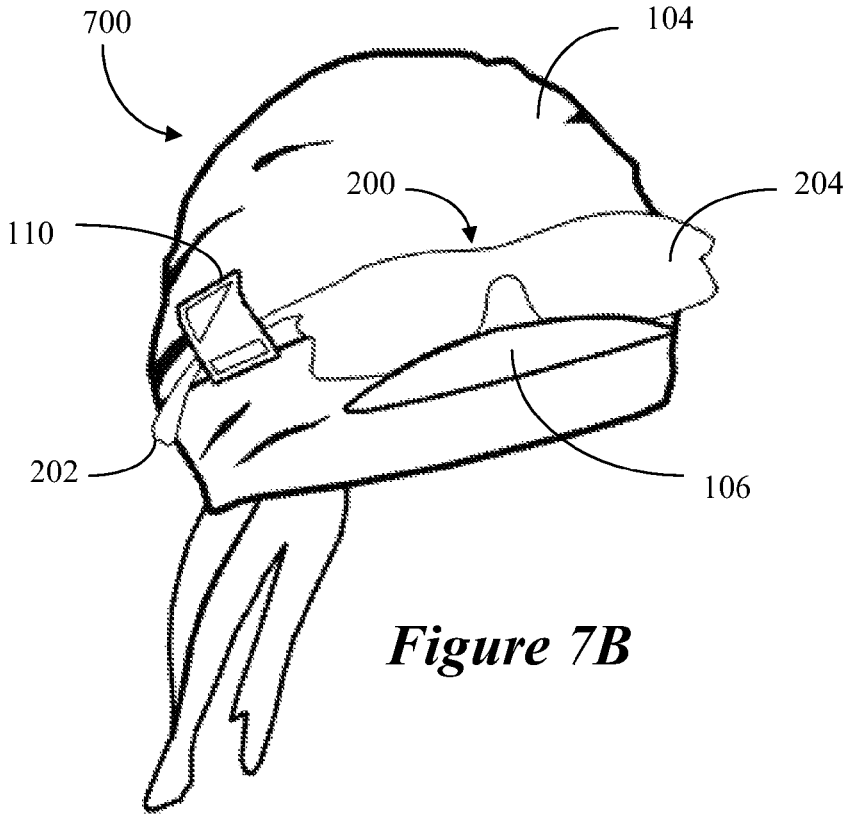
FIG. 7B is a perspective view of a brimless headwear article having features for holding a pair of eyeglasses on its crown and showing a pair of eyeglasses mounted thereon, in accordance with certain exemplary embodiments of the present invention.

As mentioned, the eyeglass holding features of the present invention may be used in connection with headwear that does not include a brim, such as stocking hats, brimless helmets, do-rags, etc. In particular, as shown in FIGS. 7A and 7B, stem holders 110 may be added to opposing sides of the crown 104 of a brimless headwear 700 and a raised flair 106 may be added to the front of the crown 104. The stem holders 110 and raised flair 106 may be added to the crown 104 using stitching, adhesive or any other appropriate fastening mechanism, as described previously. The raised flair 106 may be shaped and attached to the crown 104 of the brimless headwear 700 so as to form a pocket 108 or groove between the raised flair 106 and at least a portion of the crown 104. As described above, the lens portion 204 of the glasses 200 will rest in the pocket 108 or groove and the stems 202 of the glasses 200 will fit within the stem holders 110.

From a reading of the description above pertaining to various exemplary embodiments, many other modifications, features, embodiments and operating environments of the present invention will become evident to those of skill in the art. The features and aspects of the present invention have been described or depicted by way of example only and are therefore not intended to be interpreted as required or essential elements of the invention unless otherwise so stated. It should be understood, therefore, that the foregoing relates only to certain exemplary embodiments of the invention, and that numerous changes and additions may be made thereto without departing from the spirit and scope of the invention as defined by any appended claims.

What is claimed is:

1. Headwear with features for holding a pair of glasses thereon, the pair of glasses having stems and a lens portion, the headwear comprising:

a crown having stem holders on opposing sides thereof, wherein each stem holder is designed to receive one of the stems of the pair of glasses;

a brim attached to the crown, said brim having a width that extends between the opposing sides of the crown, and wherein the brim comprises an inner support structure covered by a cover material;

a raised flair formed as part of the inner support structure and positioned on the brim so that it creates a pocket between the raised flair and the crown, said pocket for receiving the lens portion of the pair of glasses; and wherein the raised flair is arced along its length, which runs along the width of the brim, and wherein the raised flair is tallest at its center point and tapers in height towards each of its ends.

2. The headwear of claim 1, wherein the raised flair is at least partially covered by the cover material when the brim is fully constructed.

3. The headwear of claim 1, wherein each stem holder comprises a patch of material attached to the crown along a top edge and a bottom edge of the patch, so as to form an opening extending from a front edge to a back edge of the patch;

wherein the front edge and the back edge of the patch are each partially attached to the crown in such a manner that the opening is larger along the front edge than along the back edge; and wherein portions of an interior of the patch are attached to the crown in such a manner that at least a portion of the opening is angled downward in a direction from the front edge to the back edge of the patch.

4. Headwear with features for holding a pair of glasses thereon, the pair of glasses having stems and a lens portion, the headwear comprising:

a crown having stem holders on opposing sides thereof, wherein each stem holder is designed to receive one of the stems of the pair of glasses;

a brim attached to the crown, said brim having a width that extends between the opposing sides of the crown, and wherein the brim comprises an inner support structure covered by a cover material;

a raised flair attached to the inner support structure and positioned on the brim so that it creates a pocket between the raised flair and the crown, said pocket for receiving the lens portion of the pair of glasses;

wherein the raised flair is arced along its length, which runs along the width of the brim, and wherein the raised flair is tallest at its center point and tapers in height towards each of its ends; and wherein the raised flair is at least partially covered by the cover material when the brim is fully constructed.

5. The headwear of claim 4, wherein each stem holder comprises a patch of material attached to the crown along a top edge and a bottom edge of the patch, so as to form an opening extending from a front edge to a back edge of the patch;

wherein the front edge and the back edge of the patch are each partially attached to the crown in such a manner that the opening is larger along the front edge than along the back edge; and wherein portions of an interior of the patch are attached to the crown in such a manner that at least a portion of the opening is angled downward in a direction from the front edge to the back edge of the patch.

6. Headwear with features for holding a pair of glasses thereon, the headwear comprising:

a crown;

a brim attached to the crown, said brim having a width that extends between opposing sides of the crown and wherein the brim comprises an inner support structure covered by a cover material;

a raised flair formed as part of the inner support structure and positioned on the brim so that it creates a pocket between the raised flair and the crown, said pocket for receiving a lens portion of the pair of glasses; and wherein the raised flair is arced along its length, which runs along the width of the brim, and wherein the raised flair is tallest at its center point and tapers in height towards each of its ends.

7. The headwear of claim 6, wherein the raised flair is at least partially covered by the cover material when the brim is fully constructed.

8. Headwear with features for holding a pair of glasses thereon, the headwear comprising:

a crown;

a brim attached to the crown, said brim having a width that extends between opposing sides of the crown and wherein the brim comprises an inner support structure covered by a cover material;

a raised flair attached to the inner support structure and positioned on the brim so that it creates a pocket between the raised flair and the crown, said pocket for receiving a lens portion of the pair of glasses;

wherein the raised flair is arced along its length, which runs along the width of the brim, and wherein the raised flair is tallest at its center point and tapers in height towards each of its ends; and wherein the raised flair is at least partially covered by the cover material when the brim is fully constructed.

* * * * *